US007628413B2

(12) United States Patent
Gallipoli

(10) Patent No.: US 7,628,413 B2
(45) Date of Patent: Dec. 8, 2009

(54) WHEELED TERRAIN BOARD AND FRAME THEREFOR

(76) Inventor: Wayne Gallipoli, 162 Bellevue Ave., West Haven, CT (US) 06516

( * ) Notice: Subject to any disclaimer, the term of this patent is extended or adjusted under 35 U.S.C. 154(b) by 0 days.

(21) Appl. No.: 10/873,019

(22) Filed: Jun. 21, 2004

(65) Prior Publication Data

US 2005/0280231 A1 Dec. 22, 2005

(51) Int. Cl.
*B62M 1/00* (2006.01)

(52) U.S. Cl. ..... 280/87.05; 280/87.042; 280/786

(58) Field of Classification Search ..... 280/87.042, 280/87.05, 786; 135/75; 403/83; 180/906
See application file for complete search history.

(56) References Cited

U.S. PATENT DOCUMENTS

| | | | | | |
|---|---|---|---|---|---|
| 1,996,671 | A * | 4/1935 | Busby | 280/11.223 |
| 3,993,318 | A * | 11/1976 | Rothmayer | 280/11.26 |
| D244,706 | S * | 6/1977 | Vela | D21/779 |
| 4,189,164 | A * | 2/1980 | Moorer | 280/87.05 |
| 4,324,502 | A * | 4/1982 | Pickles | 403/104 |
| 4,458,907 | A | 7/1984 | Meredith | 280/87.04 |
| 4,478,081 | A * | 10/1984 | Greene | 73/487 |
| 4,727,958 | A * | 3/1988 | Botello | 182/15 |
| 4,951,958 | A | 8/1990 | Chao | 280/87.041 |
| 5,009,337 | A * | 4/1991 | Bimbi | 224/400 |
| 5,042,831 | A * | 8/1991 | Kuhns | 280/656 |
| 5,048,851 | A * | 9/1991 | Alarcon | 280/87.042 |
| 5,417,444 | A | 5/1995 | Chen | 280/87.042 |
| 5,638,851 | A * | 6/1997 | Baldwin | 135/124 |
| 5,660,425 | A * | 8/1997 | Weber | 296/163 |
| 5,665,911 | A * | 9/1997 | Warkotsch | 73/487 |
| 5,769,104 | A * | 6/1998 | Uemura | 135/69 |
| 5,769,438 | A | 6/1998 | Svetlov | 280/87.041 |
| 5,794,955 | A | 8/1998 | Flynn | 280/87.042 |
| 5,881,937 | A * | 3/1999 | Sadler | 224/509 |
| 5,934,820 | A * | 8/1999 | Hinkle | 404/26 |
| 5,997,018 | A * | 12/1999 | Lee | 280/87.042 |
| 6,170,840 | B1 * | 1/2001 | Mathias | 280/87.041 |
| 6,202,663 | B1 * | 3/2001 | Uemura | 135/65 |
| 6,227,555 | B1 | 5/2001 | Wang et al. | 280/87.042 |
| 6,250,839 | B1 * | 6/2001 | Lenhart | 403/109.5 |
| 6,338,494 | B1 | 1/2002 | Killian | 280/87.042 |
| 6,425,618 | B1 * | 7/2002 | Garland et al. | 296/3 |
| 6,460,866 | B1 * | 10/2002 | Altschul et al. | 280/30 |
| 7,100,961 | B2 * | 9/2006 | Moen et al. | 296/100.18 |
| 2002/0089137 | A1 | 7/2002 | Chang et al. | 280/87.041 |
| 2003/0164269 | A1 | 9/2003 | Attey | 188/19 |

* cited by examiner

*Primary Examiner*—Paul N Dickson
*Assistant Examiner*—John D Walters
(74) *Attorney, Agent, or Firm*—Wiggin and Dana LLP

(57) ABSTRACT

A wheeled terrain board upon which a rider stands to traverse a terrain surface includes a deck mounted to a frame, a pair of trucks disposed at opposing ends of the frame, and a pair of wheels supported by each of the trucks. The length of the frame is adjustable to allow the terrain board to be adapted to various terrain surfaces and riding styles. The frame includes a central portion and front and rear end portions. Sliding at least one of the front and rear end portions relative to the central portion adjusts the length of the terrain board, and may be used to adjust the position of the deck relative to the trucks. Locking mechanisms may be disposed between the central portion and the front and rear end portions to secure the frame in any one of a plurality of lengths. The adjustable length frame may be used with any commercially available deck, truck, and wheels, which gives the rider more flexibility in configuring the terrain board to a particular riding style or terrain surface.

6 Claims, 6 Drawing Sheets

WHEELED TERRAIN BOARD AND FRAME THEREFOR

BACKGROUND

1. Field of the Invention

The present invention relates to wheeled terrain boards such as skateboards, long boards, mountain boards, all-terrain boards, scooters, and the like, more specifically the present invention is directed to wheeled terrain boards and frames for wheeled terrain boards.

2. Description of Related Art

Wheeled terrain boards typically include a deck on which a rider stands with both feet, and a pair of wheels supported at either end of the deck by trucks. Wheeled terrain boards include skateboards, long boards, street boards, scooters, all-terrain boards, mountain boards and the like.

Skateboards are one of the most well-known types of wheeled terrain boards. Skateboards, which are primarily used on streets, skate parks, half-pipes, or other hard and smooth surfaces, have relatively lightweight construction and a solid (e.g., polyurethane) wheel design. Long boards and street boards are, in general, skateboards that have a large deck, which allows for increased ride stability at faster speeds. Long boards and street boards are used primarily on the street or other paved surfaces.

An all-terrain board, also known by its acronym, "ATB", is a relatively new type of wheeled terrain board, somewhat similar in nature to a skate board, but which can be ridden on all forms of terrain, including the roughest of terrain found on mountains, hills, valleys, rough and rocky roads, dirt roads, as well as grassy terrain and sand. ATBs can also be ridden on paved streets, but are built to enable the rider to conquer all forms of land terrain. ATBs are often ridden on the mountains of ski and snow board resorts during the spring, summer and fall when there is little or no snow, and thus provide resort operators and their customers with an exciting off-season sport. Mountain boards are similar to ATBs, but are not built for use on paved streets. Unlike skateboards, both ATBs and mountain boards typically have pneumatic tires (e.g., rubber inflated tires on rims). One example of an ATB is provided in U.S. Pat. No. 5,997,018 to Lee, entitled "All Terrain Sport Board And Steering Mechanism For Same."

Scooters may be similar to an all-terrain board, mountain board, skateboard, long board, or street board, but with the distinguishing feature of having a handle extending above the deck for grasping by the rider.

These different types of wheeled terrain boards present the modern rider with many options, and require the rider to purchase many different boards for use on different terrain. This can be costly, especially where the rider wants to experiment with different commercially available components (e.g., decks, trucks, and tires) to find those components that are most effective for his or her riding style on a particular terrain surface.

A skateboard having an adjustable length is described in U.S. Pat. No. 4,458,907 to Meridith, entitled "Skateboard". This patent describes a skateboard having a deck with front and rear members. Associated sets of wheels are attached to each of the front and rear members, and a removable deck insert may be inserted between or removed from the deck to provide extended or retracted lengths of the skateboard. The removable insert may be installed to lengthen the board for adult use, or removed to shorten the board for a child's use. Problematically, the skateboard described in the '907 patent provides only two discrete lengths—one for children and one for adults. Also, the skateboard requires a special deck with complex hardware attachments beneath the deck.

BRIEF SUMMARY OF THE INVENTION

The above described and other drawbacks and deficiencies are overcome or alleviated by a frame for a wheeled terrain board. The frame comprises a central portion and front and rear end portions. The front end portion has a truck support member disposed thereon for receiving a front truck of the wheeled terrain board. The rear end portion has a truck support member disposed thereon for receiving a rear truck of the wheeled terrain board. A length of the frame between a distal end of the front end portion and a distal end of the rear end portion is adjustable.

In various embodiments, the front and/or rear end portions are slidably supported by the central portion, such that sliding either of the front end portion or the rear end portion relative to the central portion adjusts the length of the frame. The front and rear end portions may be telescopically received within the central portion. Preferably, the front end portion and the rear end portion are independently adjustable relative to the central portion. The length of the frame may be adjustable to a plurality of lengths between a minimum length and a length greater than about 1.5 times the minimum length.

Locking mechanisms may be disposed between the central portion and the front and rear end portions. The locking mechanisms secure the frame in any one of a plurality of lengths, and may be selected from: fasteners, ball locking mechanisms, and friction couplings.

BRIEF DESCRIPTION OF THE DRAWINGS

The invention will be more fully understood from the following detailed description taken in conjunction with the accompanying drawings wherein like elements are numbered alike, and in which.

DETAILED DESCRIPTION

Figure 1:
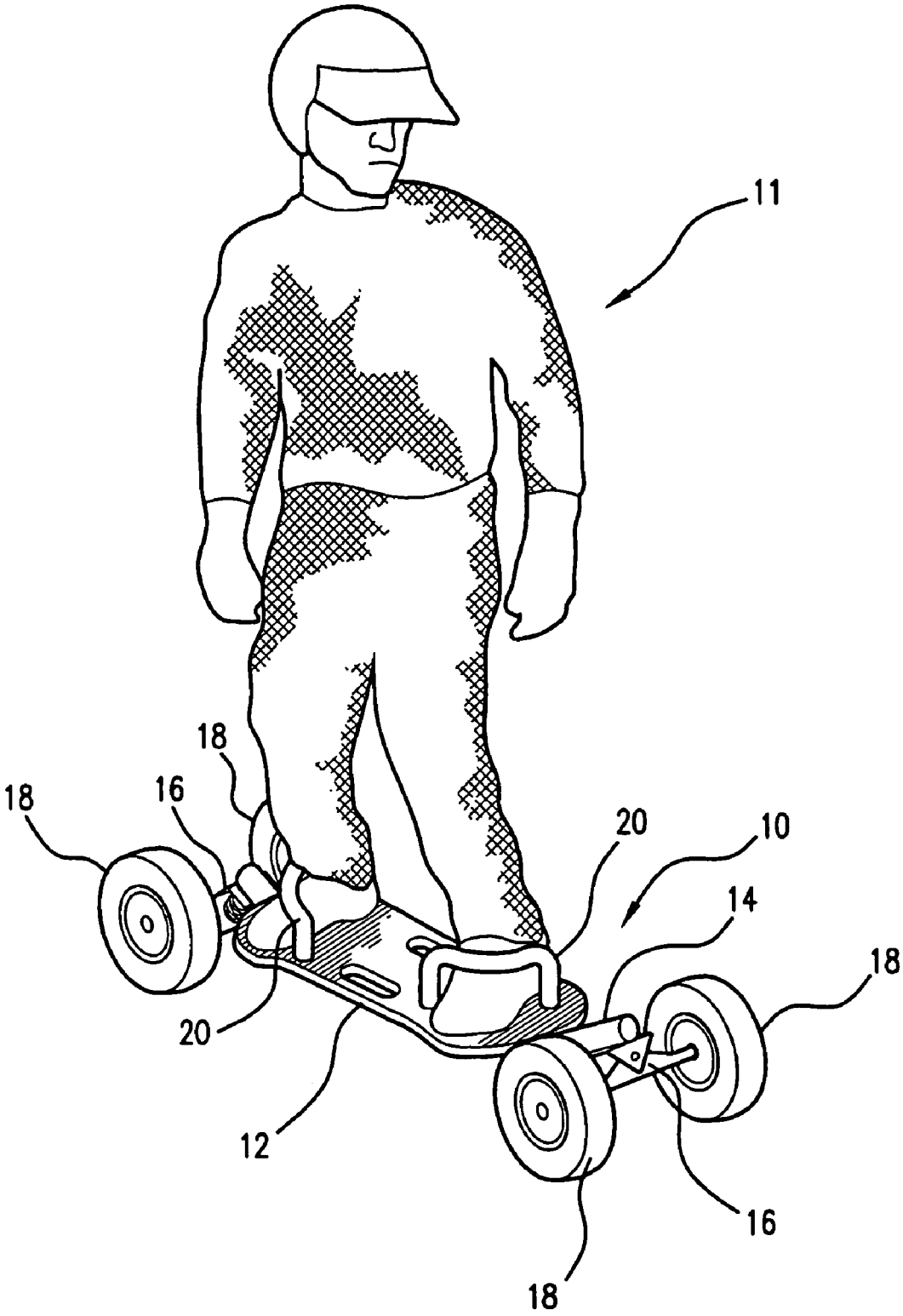
FIG. 1 depicts a rider riding a wheeled terrain board of the present invention.
Figure 2A:
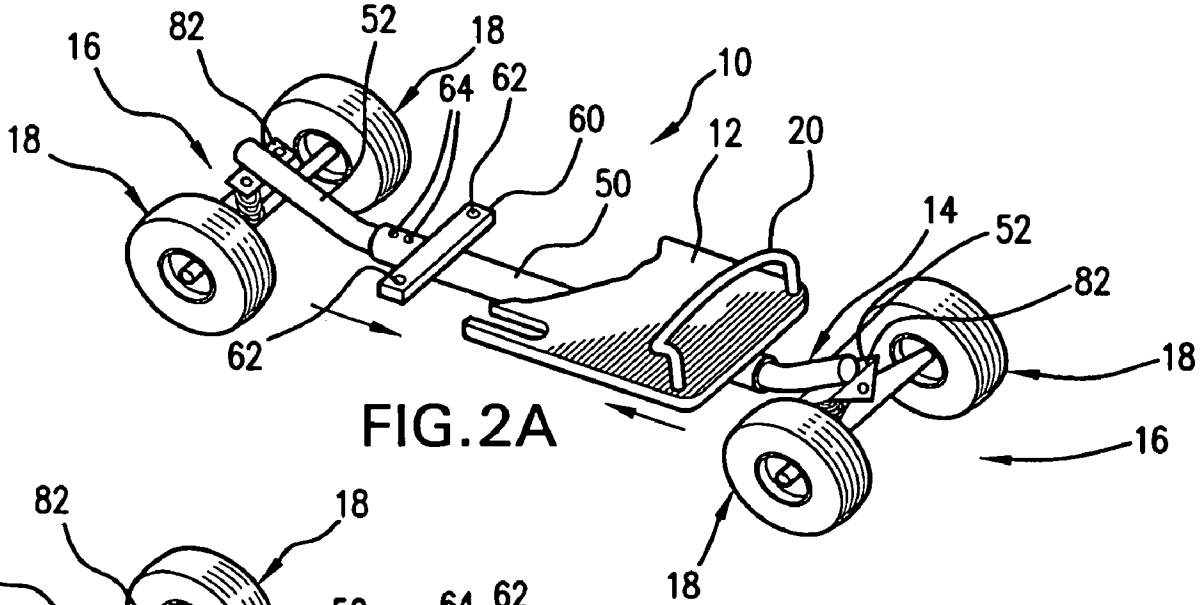
FIG. 2*a* is a partial cut-away perspective view of a wheeled terrain board of the present invention in a retracted condition.
Figure 2B:
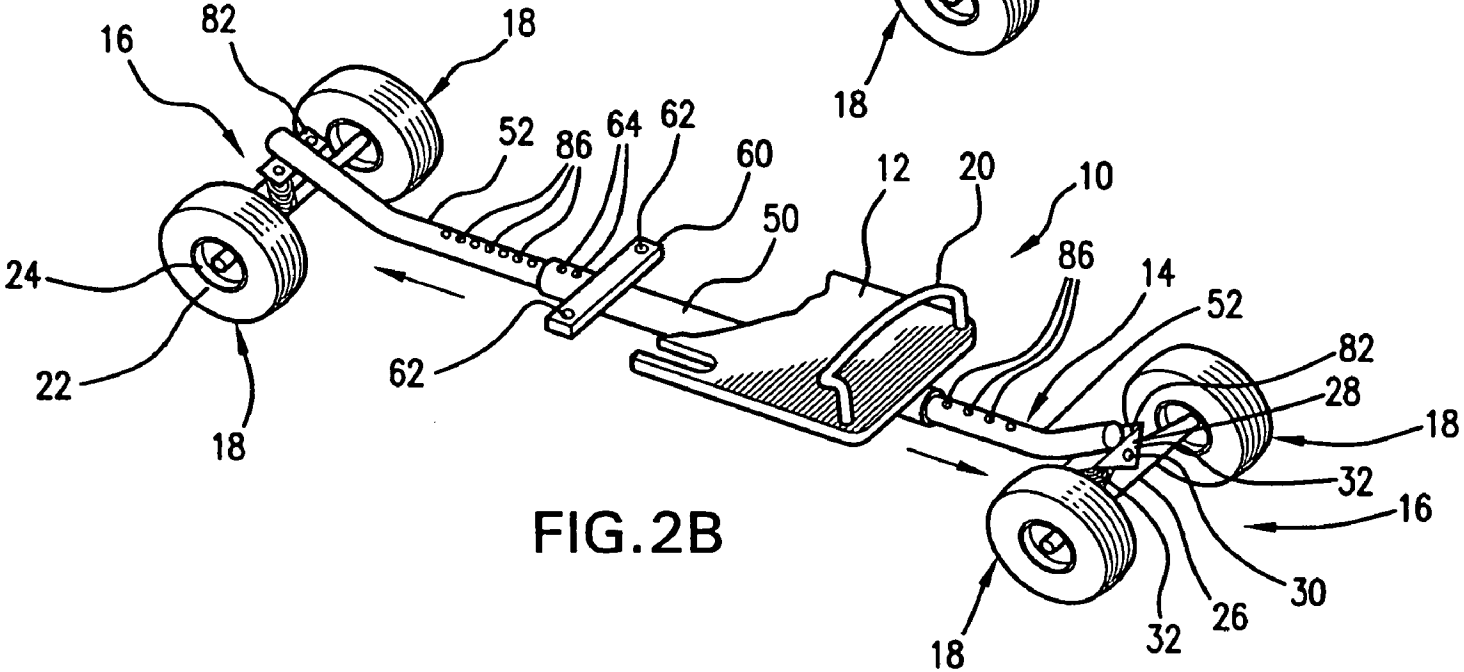
FIG. 2*b* is a partial cut-away perspective view of a wheeled terrain board of the present invention in an extended condition.

FIG. 1 depicts wheeled terrain board 10 upon which a rider 11 stands to traverse a terrain surface. The terrain board 10 includes a deck 12 mounted to a frame 14, a pair of trucks 16 disposed at opposing ends of the frame 14, and a pair of wheels 18 supported by each of the trucks 16. The length of the frame 14 is adjustable to allow the terrain board 10 to be adapted to various terrain surfaces and riding styles. For example, where the rider 11 desires quicker turning, as may be desired for off-road or slalom riding, the frame 14 can be shortened, as shown in FIG. 2*a*. Where the rider 11 desires more stability at higher speeds, as may be required for street cruising, the frame 14 can be lengthened, as shown in FIG. 2*b*. Advantageously, the adjustable length frame 14 may be used with any commercially available deck 12, trucks 16, and wheels 18, which gives the rider 11 more flexibility in configuring the terrain board 10 to a particular riding style or terrain surface. Indeed, it is contemplated that a rider 11 may own a single terrain board 10 of the present invention that can be used for a number of different terrains or riding styles. Typically, one would own different boards for different applications.

It is contemplated that the wheeled terrain board 10 in accordance with the present invention may be any type of wheeled terrain board including, for example, skateboards, long boards, mountain boards, all-terrain boards, scooters, and the like. The deck 12, trucks 16, and wheels 18 may be of any type suitable for the terrain on which the terrain board 10 is to be used. For example, the deck 12, trucks 16, and wheels 18 maybe as described in U.S. Pat. No. 5,997,018 entitled "All Terrain Sport Board And Mechanisms For Same", issued Dec. 7, 1999, which is incorporated by reference herein in its entirety. In another example, the deck 12, trucks 16, and wheels 18 may be those commercially available from MBS™ High Performance All-Terrain Boards of Colorado Springs, Colo.

The deck 12 has a generally planar top surface on which the rider 11 stands. The deck 12 may be made from any rigid material, such as, for example, wood, plastic, fiberglass, carbon fiber, composite materials, and the like. Although not shown, it will be appreciated that the deck 12 may be fitted with bindings 20 to releasably retain the rider's feet to the deck 12 (see FIG. 1). The deck 12 may be of any convenient shape, and may include cleats for attaching a leash to be attached to or held by the rider 11.

Each wheel 18 may include a pneumatic tire 22 attached to a rim 24, as found on mountain or all-terrain boards. The tires 22 may have a tread or lugs, or may be smooth (slicks). Alternatively, the wheels 18 may be solid wheels, such as those typically found on skateboards and scooters. Such solid wheels are typically made from polyurethane, rubber, silicon, or other resilient materials.

Trucks 16 may be any device that supports the wheels 18 and allows the terrain board 10 to turn in response to a shift in the rider's weight. For example, the trucks 16 typically include an axle portion 26 attached to an upper portion 28 at a pivot point 30, with one wheel 18 being disposed on each end of the axle portion 26. Disposed between the axle portion 26 and the upper portion 28 are resilient members 32 (e.g., springs or grommets). As is well known, to turn the terrain board 10, the rider 11 shifts his or her weight to one side of the deck 12 or the other (i.e., one side of the pivot point 30 or the other) in the direction of the desired turn. This shift in weight causes the upper portion 28 of the trucks 16 to pivot around the pivot point 30, which causes the axle portion 26 to turn laterally in the direction of the desired turn. The resilient members 32 act to return the axle portion 26 to a quiescent position after the rider's weight is shifted back over the center of the deck 12 (i.e., the center of the pivot point 30).

As described in U.S. Pat. No. 5,997,018, the trucks 16 may include shock absorbing (suspension) features. It is also contemplated that suspension features (e.g., springs, rubber grommets, and other shock absorbing devices) may be disposed between the trucks 16 and the frame 14. In addition, hand brakes (not shown) may be attached to the frame 14 and/or trucks 16, as described in U.S. Pat. No. 5,997,018.

Figures 3A, 3B, 3C:
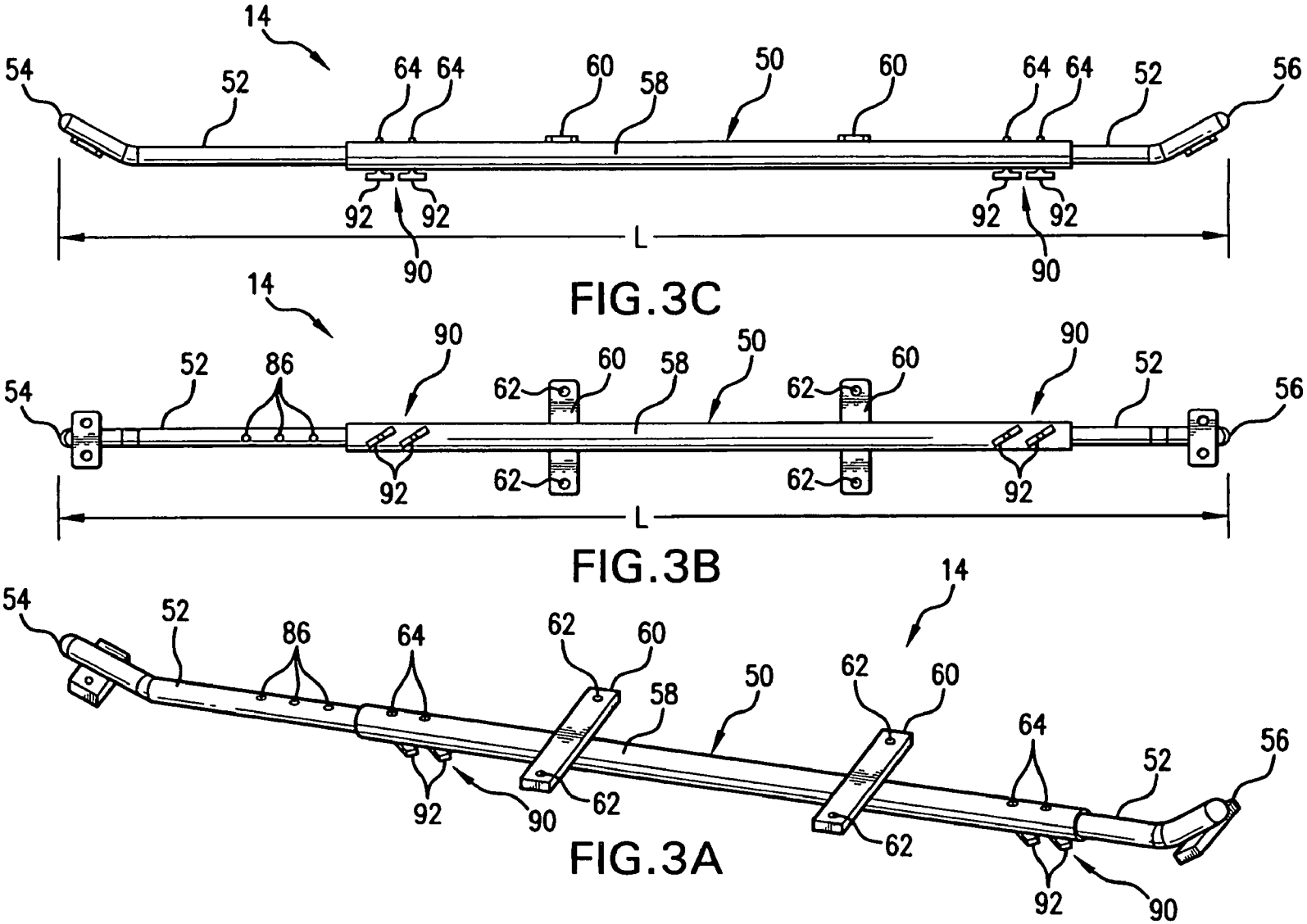
FIG. 3*a* is a perspective view of an adjustable length frame for the wheeled terrain board of FIG. 2.
FIG. 3*b* is a plan view of the adjustable length frame.
FIG. 3*c* is an elevation view of the adjustable length frame.

In the embodiment shown, the frame 14 includes a central portion 50 onto which the deck 12 is fixed. The frame 14 also includes two end portions 52 received within the central portion 50. Referring now to FIGS. 3*a*-3*c*, a perspective view, plan view, and elevation view of the frame 14 are shown, respectively. As can be seen in FIGS. 3*a*-3*c*, the frame 14 has a length L, which is defined as the distance between the distal ends 54 and 56 of the frame. Each end portion 52 is telescopically received within the central portion 50. By telescopically received, it is meant that each end portion 52 is coaxially aligned with, and received within the central portion 50 such that at least a portion of the end portions 52 can slide into and out of the central portion 50. In this manner, the length L of the frame 14 can be adjusted. In the embodiment shown, for example, the length L may be adjusted to a plurality of lengths L between a minimum length L and a maximum length L, where the maximum length L is greater than about 1.5 times the minimum length L. For example, it is contemplated that the length L may be adjustable to between a minimum length of about 48 inches to a maximum length of about 94 inches.

While the embodiment of FIGS. 3*a*-3*c* show the end portions 52 as being telescopically received within the central portion 50, it is contemplated that any arrangement that allows one or more of the end portions 52 to slide relative to the central portion 50 may be used. For example, the central portion 50 may be telescopically received within one or more of the end portions 52, or the central portion 50 and one or more of the end portions 52 may be coupled side-by-side. Preferably, both end portions 52 are independently adjustable relative to the central portion 50, as shown in the embodiment of FIGS. 2*a*-2*b* and 3*a*-3*c*, because this allows the position of the deck 12 relative to the front and/or rear trucks 16 to be easily adjusted by adjusting any one or both of the end portions 52. That is, the deck 12 can be placed closer to a front truck 16, closer to a rear truck 16, or centered between the front and rear trucks 16, as desired by the rider.

In the embodiment of FIGS. 3*a*-3*c*, the central portion 50 includes a hollow, cylindrical tube 58 formed from a rigid material such as metal, composite, or the like. Attached to an outer surface of the tube 58 are cross support members 60, which support the bottom of the deck 12, as shown in FIGS. 2*a*-2*b*. Holes 62 disposed through the cross support members 60 receive fasteners (e.g., bolts, screws, and the like) for attaching the deck 12 to the cross support members 60. Disposed through the central portion 50 are holes 64, the function of which will be described in further detail hereinafter.

Figure 4A:
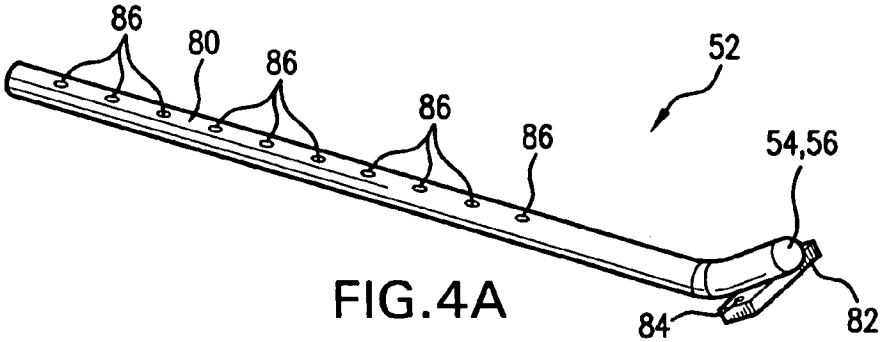
FIG. 4*a* is a perspective view of an end portion of the adjustable length frame of FIG. 3.
Figure 4B:
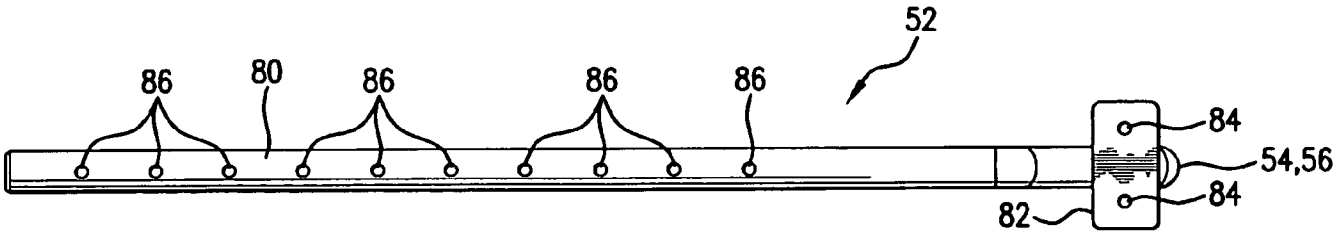
FIG. 4*b* is a plan view of the end portion.
Figure 4C:
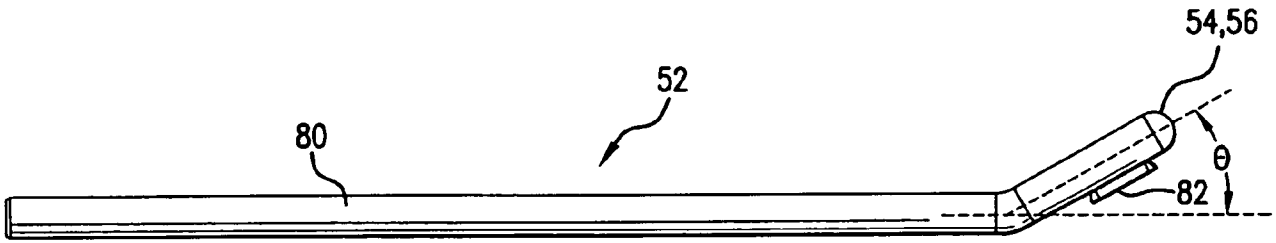
FIG. 4*c* is an elevation view of the end portion.

Referring now to FIGS. 4*a*-4*c*, a perspective view, plan view, and elevation view of an end portion 52 are shown, respectively. In the embodiment shown, the end portion 52 is formed from a generally cylindrical bar 80 of a rigid material such as metal, composite, or the like. Proximate its distal end (54 or 56), bar 80 is bent to an angle 0 suitable for the type of truck to be attached to the end portion. For example, where a truck of the type described in U.S. Pat. No. 5,997,018 is used, the angle θ may be about 30 degrees. Attached to the bar 80 proximate the distal end is a truck support member, which in this embodiment is a plate 82, to which the truck 16 is attached (See FIGS. 2*a*-2*b*). Holes 84 disposed through the plate 82 receive fasteners (e.g., bolts) for attaching the truck 16 to the plate 82. It is contemplated that a number of different patterns of holes 84 may be disposed in plate 82 so that a number of different commercially available truck systems may be attached to the plate 82. The bar 80 forming the end portion includes holes 86 disposed therethrough, the function of which will be described in further detail hereinafter. While the truck support member is shown as a plate 82, it will be appreciated that the truck support member may include any surface to which a truck may be mounted.

In the embodiment shown in FIGS. 3*a*-3*c* and 4*a*-4*c*, the central portion 50 and the end portions 52 are each cylindrical, having a circular cross section. It is contemplated that other geometrical shapes (e.g., oval, square, triangular, various polygons, etc.) may be used as the cross sectional shape of the central portion 50 and the end portions 52.

Referring again to FIGS. 3*a*-*c*, disposed between the central portion 50 and each of the end portions 52 are locking mechanisms 90. The locking mechanisms 90 include any device that releasably secures the end portions 52 from sliding relative to the central portion 50. In the embodiment of FIGS. 3*a*-3*c*, locking mechanisms 90 each include pins (fasteners) 92, which extend through cooperating holes 64 and 86 in the central and end portions 50 and 52, respectively. To change the length L of the frame 14, the pins 92 are removed, one or more end portion 52 is slid into or out of the central portion 50 until the desired length L is achieved, and the pins 92 are then inserted into the cooperating holes 64 and 86 in the central and end portions 50 and 52. The pins 92 are preferably locking, quick release pins such as Kwik-Lok™ T-handle pins manufactured by Jergens, Inc. of Cleveland, Ohio. With the locking mechanism 90 of FIGS. 3*a*-3*c*, the number of discrete lengths that the terrain board may be configured to is dependent on the number of holes 86 provided in the end portions 52. For example, in the embodiment shown, the frame provides for 18 different lengths (9 holes 86 in each end portion 52).

Figure 5:
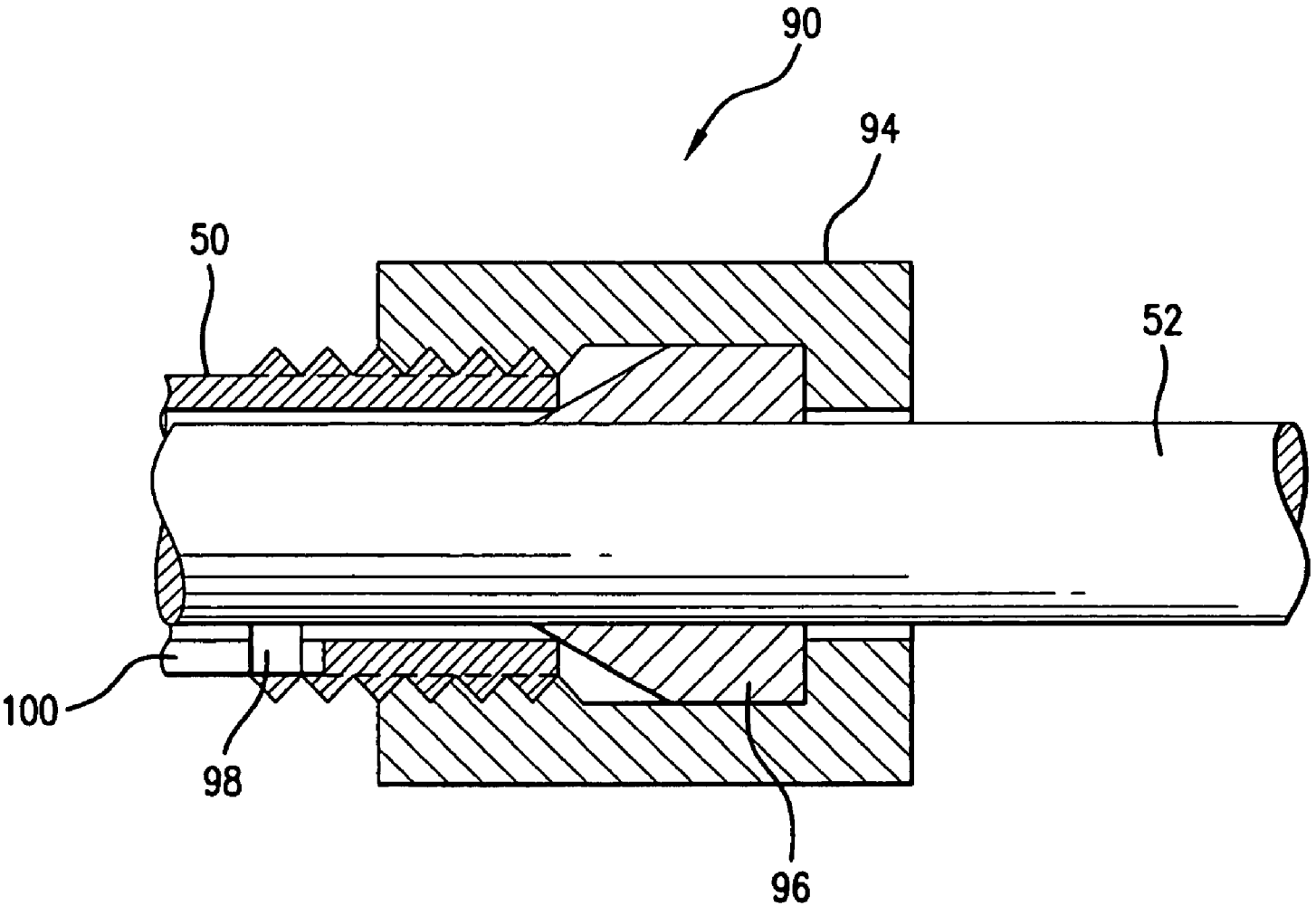
FIG. 5 is an alternative locking mechanism for use with the adjustable length frame of FIG. 3.

FIG. 5 depicts an alternative locking mechanism 90. The locking mechanism 90 of FIG. 5 is a friction coupling, which includes a sleeve 94 threaded to central portion 50. A locking ring 96 is disposed around the end portion 52, between the sleeve 94 and the central portion 50. The locking ring 96 may be made of resilient material such as rubber, teflon, or the like. Tightening the sleeve 94 onto the central portion 50 compresses the locking ring 96 onto the end portion 52, thus preventing sliding of the end portion 52 relative to the central portion 50. To prevent axial rotation of the end portion 52 relative to the central portion 50, the end portion 52 may include a pin 98 extending therefrom and disposed within a channel 100 formed in the central portion 50. With the locking mechanism 90 of FIG. 5, the terrain board 10 may be configured to an infinite number of discrete lengths L between a maximum extended length (e.g., where the end portions 52 are sufficiently received within the central portion 50 to provide structural support) and a minimum extended length (e.g., where the end portions 52 are fully inserted into the central portion 50). The pin 98 and channel 100 may be used to define the maximum and minimum extended lengths.

Figure 6A:
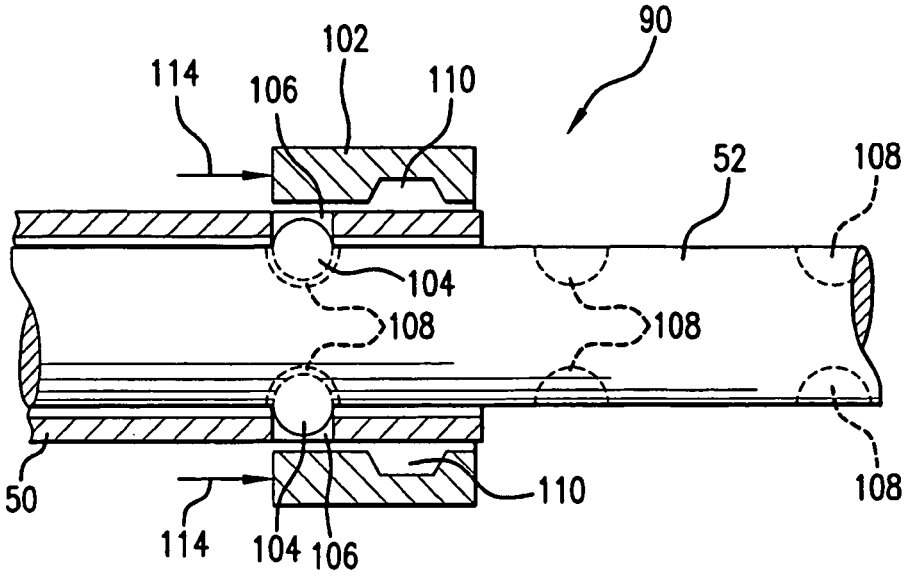
FIG. 6*a* is another alternative locking mechanism for use with the adjustable length frame of FIG. 3 in a locked condition.
Figure 6B:
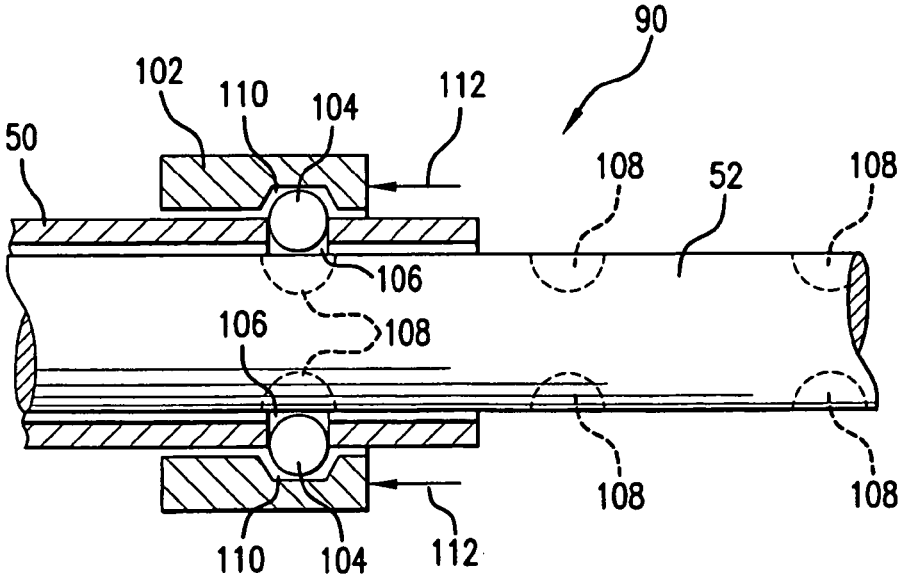
FIG. 6*b* is the alternative locking mechanism of FIG. 6*a* in an unlocked condition.

FIG. 6*a*-6*b* depicts another alternative locking mechanism 90. The locking mechanism 90 of FIG. 6 is a ball locking mechanism, which includes a sleeve 102 disposed around the central portion 50. The sleeve 102 retains balls 104 within apertures 106 in the central portion 50. The end portion 52 includes a plurality of recesses 108 disposed therein for receiving the balls 104 when the locking mechanism 90 is in a locked condition, as shown in FIG. 6*a*. The sleeve 102 includes recesses 110 disposed therein for receiving the balls 104 when the locking mechanism is in an unlocked condition as shown in FIG. 6*b*.

Referring to FIG. 6*b*, to place the locking mechanism 90 in an unlocked condition, the sleeve 102 is slid in the direction of arrows 112 until the recesses 110 are aligned with the apertures 106, which allows the balls 104 to move out of the recesses 108 in the end portion 52 and into the recesses 110 in the sleeve 102. With the balls 104 free from recesses 108, the end portion is free to be slid into or out of the central portion 50 to adjust the length of the frame 14.

Referring to FIG. 6*a*, to place the locking mechanism 90 in a locked condition, the end portion 52 is slid into or out of the central portion 50 until the recesses 108 in the end portion 50 are aligned with the apertures 106 in the central portion 50, which allows the balls 104 to move into the recesses 108. The sleeve 102 is then slid in the direction of arrows 114 to place the recesses 110 in the sleeve 102 out of alignment with the apertures 106, thus locking the balls 104 into the recesses 108. It will be appreciated that the sleeve 102 may be biased in the direction of arrows 104 or otherwise maintained in the position shown in FIG. 6*a* to ensure the locked condition. It will also be appreciated that the sleeve 102 may be prevented from sliding off the central portion using any conventional means. With the locking mechanism 90 of FIG. 6*a*-6*b*, the number of discrete lengths that the terrain board may be configured to is dependent on the number of recesses 108 provided in the end portions 52. While FIGS. 6*a*-6*b* show one example of a ball locking mechanism, other suitable ball locking mechanisms may be used.

Referring again to FIG. 2*a*-2*b*, the terrain board 10 of the present invention includes an adjustable length frame 14 that allows the terrain board 10 to be adjusted to any one of a plurality of lengths. As a result, the terrain board 10 can be adapted to various terrain surfaces and riding styles. The adjustable length frame 14 of the present invention allows the rider who currently owns a standard skateboard, long board, mountain board, all-terrain board, scooter, and the like, to modify the length of his or her board in front of the deck, in back of the deck, or both in front and in back of the deck, while using the wheels, trucks, and deck from the existing board. The adjustable length frame 14 may be used with any commercially available deck, trucks, and wheels, to create the terrain board 10 of the present invention, which gives the rider more flexibility in configuring the terrain board 10 to a particular riding style or terrain surface. Indeed, it is contemplated that a rider may own a single terrain board 10 of the present invention that can be used for a number of different terrains or riding styles.

Although one or more embodiments of the present invention have been described, it will nevertheless be understood that various modifications may be made without departing from the spirit and scope of the invention. Accordingly, other embodiments are within the scope of the following claims.

What is claimed is:

1. A wheeled terrain board upon which a rider stands to traverse a terrain surface, the wheeled terrain board comprising:

a frame including:

an elongated central portion, an elongated front end portion extending outwardly from and along the longitudinal axis of the central portion to substantially the distal end of the front end portion, the front end portion and the central portion being telescopically received one within the other, and an elongated rear end portion extending outwardly from and along the longitudinal axis of the central portion to substantially the distal end of the rear end portion, the rear end portion and the central portion being telescopically received one within the other, at least one wheel attached to the front end portion proximate to the distal end thereof, at least one wheel attached to the rear end portion proximate to the distal end thereof, the front end portion and the rear end portion of the frame being independently adjustable relative to the central portion so that by moving either one or both of the front and rear end portions along the longitudinal axis of the central portion, the distance between the wheels attached to the front and rear end portions can be readily shortened for quicker turning or lengthened for greater stability, a first locking mechanisms disposed between the central portion and the front end portion, the front end portion being releasably secured in the longitudinal direction relative to the central portion by the first locking mechanism, a second locking mechanism disposed between the central portion and the rear end portion, the rear end portion being releasably secured in the longitudinal direction relative to the central portion by the second locking mechanism, and a deck mounted to the central portion and having a fixed length.

2. The wheeled terrain board of claim 1 wherein the length of the frame is adjustable to a plurality of lengths between a minimum length and length greater than about 1.5 times the minimum length.

3. The wheeled terrain board of claim 1, wherein at least one of the first and second locking mechanisms is a friction coupling comprising, in combination:

a sleeve threaded to the central portion and a resilient locking ring disposed between the sleeve and the front or rear end portion of the frame, whereby tightening the sleeve compresses the locking ring and prevents sliding of the front or rear end portion relative to the central portion.

4. The wheeled terrain board of claim 1, wherein at least one of the first and second locking mechanisms is a ball locking mechanism comprising, in combination:

a sleeve disposed around the central portion, at least one ball retained within an opening in the central portion for locking the mechanism, the sleeve having an opening for receiving the ball in the unlocked condition.

5. A wheeled terrain board upon which a rider stands to traverse a terrain surface, the wheeled terrain board comprising:

a frame including:

an elongated tubular central portion having axially aligned, open forward and rearward ends, an elongated, cylindrical front end portion telescopically mounted within the open forward end of the tubular central portion, the cylindrical front end portion extending outwardly from the tubular central portion along its longitudinal axis substantially to the distal end of the front end portion, an elongated, cylindrical rear end portion telescopically mounted within the open rearward end of the tubular central portion, the cylindrical rear end portion extending outwardly from the tubular central portion along its longitudinal axis substantially to the distal end of the rear end portion, a first truck including wheels mounted to the front end portion of the frame proximate the distal end thereof, a second truck including wheels mounted to the rear end portion of the frame proximate the distal end thereof, the front end portion and the rear end portion of the frame being independently adjustable relative to the central portion so that by moving either one or both of the front and rear end portions along the longitudinal axis of the central portion, the distance between the wheels on the first and second trucks can be shortened for quicker turning or lengthened for greater stability, a first and second plurality of spaced apart holes disposed within the tubular central portion, a third plurality of holes disposed within the cylindrical front end portion, at least one of the third plurality of holes aligning with a hole in the first plurality of holes, a first locking pin extending through the aligned holes in the first and third plurality of holes releasably securing the cylindrical front end portion to the tubular central portion, a fourth plurality of spaced apart holes disposed within the cylindrical rear end portion, at least one of the fourth plurality of holes aligning with a hole in the second plurality of holes, a second locking pin extending through the aligned holes in the second and fourth plurality of holes releasably securing the cylindrical rear end portion to the tubular central portion, and a deck mounted to the tubular central portion and having a fixed length.

6. A method for assembling a wheeled terrain board for use on a terrain surface comprising:

providing a frame including an elongated central portion, an elongated front end portion and an elongated rear end portion, telescopically mounting the front end portion and the central portion one within the other such that the front end portion extends outwardly from the central portion along its longitudinal axis to substantially a distal end of the front end portion, telescopically mounting the rear end portion and the central portion one within the other such that the rear end portion extends outwardly from the central portion along its longitudinal axis to substantially a distal end of the rear end portion, attaching a wheel proximate to the distal ends of both the front and rear end portions, adjusting the length to which at least one of the front end portion and the rear end portion extend longitudinally beyond the central portion such that the frame is set to a predetermined length between the wheels attached to both distal ends thereof, wherein the minimal distance between the distal ends provides for quicker turning of the terrain board and wherein the maximum distance between the distal ends provides for greater stability, releasably locking the at least one of the front end portion and the rear end portion to secure the same to the central portion, and providing a deck for mounting to the central portion, the deck having a fixed length.

* * * * *